US012403349B2

(12) United States Patent
Li

(10) Patent No.: US 12,403,349 B2
(45) Date of Patent: Sep. 2, 2025

(54) ADJUSTABLE DUMBBELL

(71) Applicant: Yongkang Zuojian Industry and Trade Co., Ltd., Yongkang (CN)

(72) Inventor: Jianjun Li, Luzhou (CN)

(73) Assignee: Yongkang Zuojian Industry and Trade Co., Ltd., Yongkang (CN)

( * ) Notice: Subject to any disclaimer, the term of this patent is extended or adjusted under 35 U.S.C. 154(b) by 82 days.

(21) Appl. No.: 18/400,295

(22) Filed: Dec. 29, 2023

(65) Prior Publication Data

US 2025/0065180 A1 Feb. 27, 2025

(30) Foreign Application Priority Data

Aug. 21, 2023 (CN) ..... 202322245566.8

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0726; A63B 21/0728; A63B 21/075
See application file for complete search history.

(56) References Cited

U.S. PATENT DOCUMENTS

| | | | | |
|---|---|---|---|---|
| 11,198,031 | B2 * | 12/2021 | Chen | A63B 21/072 |
| 11,717,714 | B1 * | 8/2023 | Hong | A63B 21/0726 482/107 |
| 2007/0184945 | A1 * | 8/2007 | Lin | A63B 21/075 482/107 |
| 2018/0353794 | A1 * | 12/2018 | Wang | A63B 71/0036 |
| 2022/0096890 | A1 * | 3/2022 | Lu | A63B 21/0728 |
| 2022/0249898 | A1 * | 8/2022 | Jiang | A63B 71/0036 |
| 2023/0001258 | A1 * | 1/2023 | Svenberg | A63B 21/0724 |

* cited by examiner

*Primary Examiner* — Evan P Dzierzynski
(74) *Attorney, Agent, or Firm* — Birchwood IP

(57) ABSTRACT

The present disclosure discloses an adjustable dumbbell including a base, a grip, and dumbbell plates on the grip. The base is provided with a dumbbell plate fix groove, a bottom of the dumbbell plate fix groove is provided with several locking pieces; a through hole is provided on the grip, an interior of the through hole is provided with a connection mechanism. Each dumbbell plate includes a shell and a weight stack arranged in the shell. The shell is fixedly connected with a positioning mechanism, a connection rod in the connection mechanism is moved towards both ends of the grip by rotating the grip. A movement length of the connection rod and the number of dumbbell plates of the grip are controlled to control a weight of the dumbbell. The dumbbell plates are easy to disassemble and assemble and the positioning mechanism prevents the dumbbell plates from falling off.

11 Claims, 7 Drawing Sheets

ADJUSTABLE DUMBBELL

CROSS-REFERENCE TO RELATED APPLICATIONS

This application claims priority to Chinese Patent Application No. 202322245566.8, filed on Aug. 21, 2023, which is hereby incorporated by reference in its entirety.

TECHNICAL FIELD

The present disclosure relates to the field of fitness equipment technologies, and in particular, to an adjustable dumbbell.

BACKGROUND

Dumbbells are widely used fitness equipment. Its middle part is a grip, and two ends are spherical or cylindrical bell bodies, which are convenient to use. However, the weight of a single dumbbell is fixed and cannot meet the needs of trainers with different strengths or usage habits. Due to the widespread use of dumbbells, users often need many dumbbell plates of different weights, and changing the weight can only be done through frequent disassembly and replacement of dumbbell plates. This frequent and cumbersome procedure brings certain troubles to users.

SUMMARY

The technical solution adopted by the present disclosure to solve the above problems is as follows.

The present disclosure provides a dumbbell that is easy to adjust, including:

- a dumbbell plate fix seat, which is provided with a dumbbell plate fix groove on the dumbbell plate fix seat, a bottom of the dumbbell plate fix groove is provided with several locking pieces;
- a grip, which is provided with a through hole, an interior of the through hole is provided with a connection mechanism, the connection mechanism includes a lead screw and a moving rod slidably connected to the lead screw, the moving rod is provided with a second positioning hole, the moving rod is fixedly connected to a connection rod, the connection rod is provided with several first position holes, the grip is connected to the several dumbbell plates;
- where each dumbbell plate includes a shell and a weight stack arranged in the shell, the shell is provided with a positioning mechanism, the positioning mechanism is provided with a dumbbell plate connection hole, the positioning mechanism includes a base and a cover plate, and a moving piece provided between the base and the cover plate; the base is provided with a third pin hole, and the moving piece is provided with a third pin above the third pin hole, an elastic member is provided between an upper of the moving piece and the base; the elastic member ensures that the moving piece is not subjected to an external force, and the third pin is located in the third pin hole; a conflict block is provided below the moving piece, the conflict block is connected to an outside through a lower of the base.

In an embodiment of the present disclosure, a side wall of the dumbbell plate fix groove is provided with a dumbbell fix block, the dumbbell plate is provided with a clamp slot, the dumbbell plate is fixed to the dumbbell fix block through the clamp slot.

In an embodiment of the present disclosure, a bottom of the dumbbell plate fix groove is provided with several dumbbell plate positioning grooves with a width consistent with that of the dumbbell plate.

In an embodiment of the present disclosure, the dumbbell plate fix seat is provided with a groove below the grip.

In an embodiment of the present disclosure, the lead screw is fixedly connected to a connection sleeve, the connection sleeve is provided with a second pin, the lead screw is fixedly connected to the grip through the second pin.

In an embodiment of the present disclosure, the grip is provided with an anti-slip sleeve and an anti-slip pattern.

In an embodiment of the present disclosure, the connection rod is provided with a first pin hole, the moving rod is provided with a first pin, and the connection rod is fixedly connected to the moving rod through the first pin.

In an embodiment of the present disclosure, the moving piece is provided with an elastic member connection block, and the elastic member is positioned through the elastic member connection block and abuts against the base.

The beneficial effects of the present disclosure are that a dumbbell that is easy to adjust is provided, which includes a dumbbell plate fix seat, a grip, and dumbbell plates on the grip. The dumbbell plate fix seat is provided with a dumbbell plate fix groove, and the bottom of the dumbbell plate fix groove is provided with several locking pieces; a through hole is provided on the grip, and the interior of the through hole is provided with a connection mechanism. The dumbbell plate includes a shell and a weight stack arranged in the shell. The shell is fixedly connected with a positioning mechanism, and the connection rod in the connection mechanism is moved towards both ends of the grip by rotating the grip. The movement length of the connection rod is controlled to control the number of pieces of dumbbell plates connected to the grip, thereby controlling the weight of the dumbbell plate. The dumbbell plates with the above structure are easy to disassemble and assemble, besides, the positioning mechanism prevents the dumbbell plates from falling off during use and has high safety.

BRIEF DESCRIPTION OF DRAWINGS

In order to provide a clearer explanation of the embodiments of the present disclosure or the technical solutions in the prior art, a brief introduction will be given below to the drawings required in description of the embodiments or prior art. It is obvious that the drawings in the following description are only some embodiments of the present disclosure. For ordinary technical personnel in this field, without creative work, other drawings can also be obtained based on the structures shown in these drawings.

Numeral reference: 1—grip, 101—anti-slip sleeve, 102—through hole, 103—connection rod, 1031—first positioning hole, 1032—first pin hole, 104—lead screw, 105—moving rod, 1051—second positioning hole, 1052—first pin, 106— second pin, 107—connection sleeve, 2—dumbbell plate fix seat, 201—dumbbell plate fix groove, 202—groove, 203—dumbbell fix block, 204—dumbbell plate positioning groove, 205—locking piece, 3—dumbbell plate, 301—shell, 301—positioning mechanism installation groove, 302—dumbbell plate connection hole, 303—clamp slot, 304—cover plate, 305—weight stack, 306—moving piece, 3061—conflict block, 3062—third pin, 3063—elastic member connection block, 307—base, 3071—third pin hole.

DESCRIPTION OF EMBODIMENTS

In order to enable those skilled in the art to better understand the technical solution of the present application, the following will provide a clear and complete description of the technical solution in the embodiments of the present application in combination with the drawings. Obviously, the described embodiments are only a part of the embodiments of the present application, not all of them. Based on the embodiments in the present disclosure, all other embodiments obtained by those skilled in the art without creative work fall within the protection scope of the present application.

Figure 1:
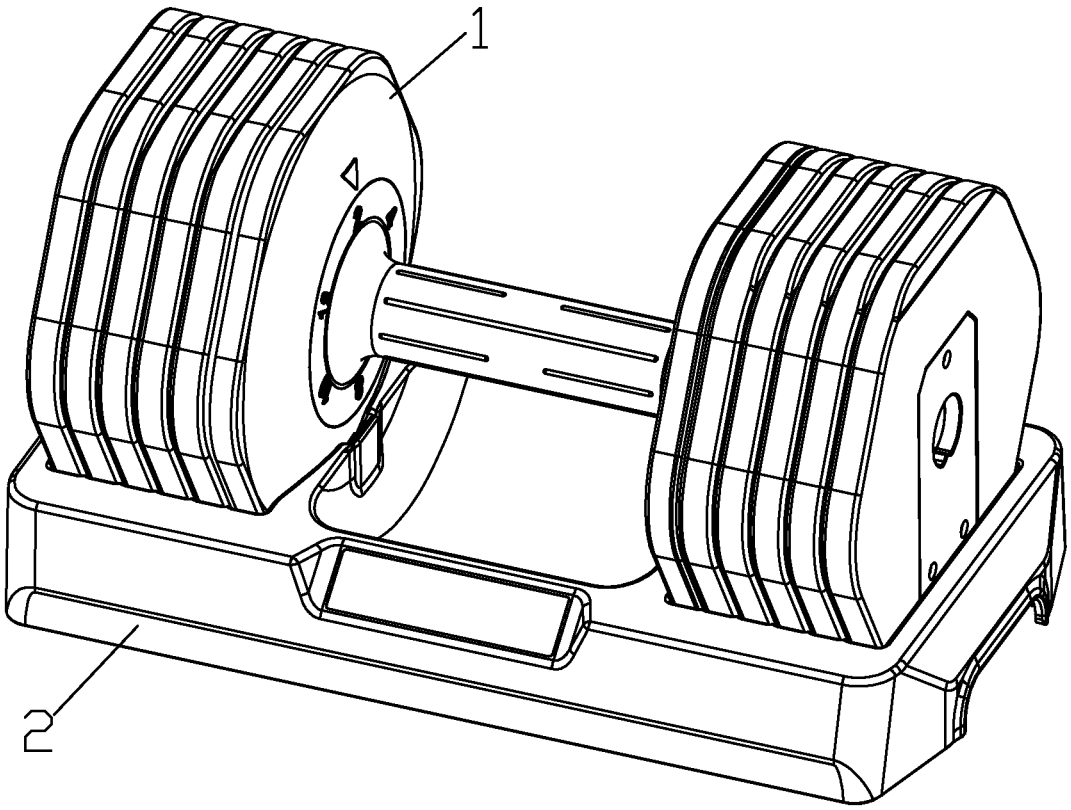
FIG. 1 is a perspective diagram of an adjustable dumbbell in the present disclosure.
Figure 2:
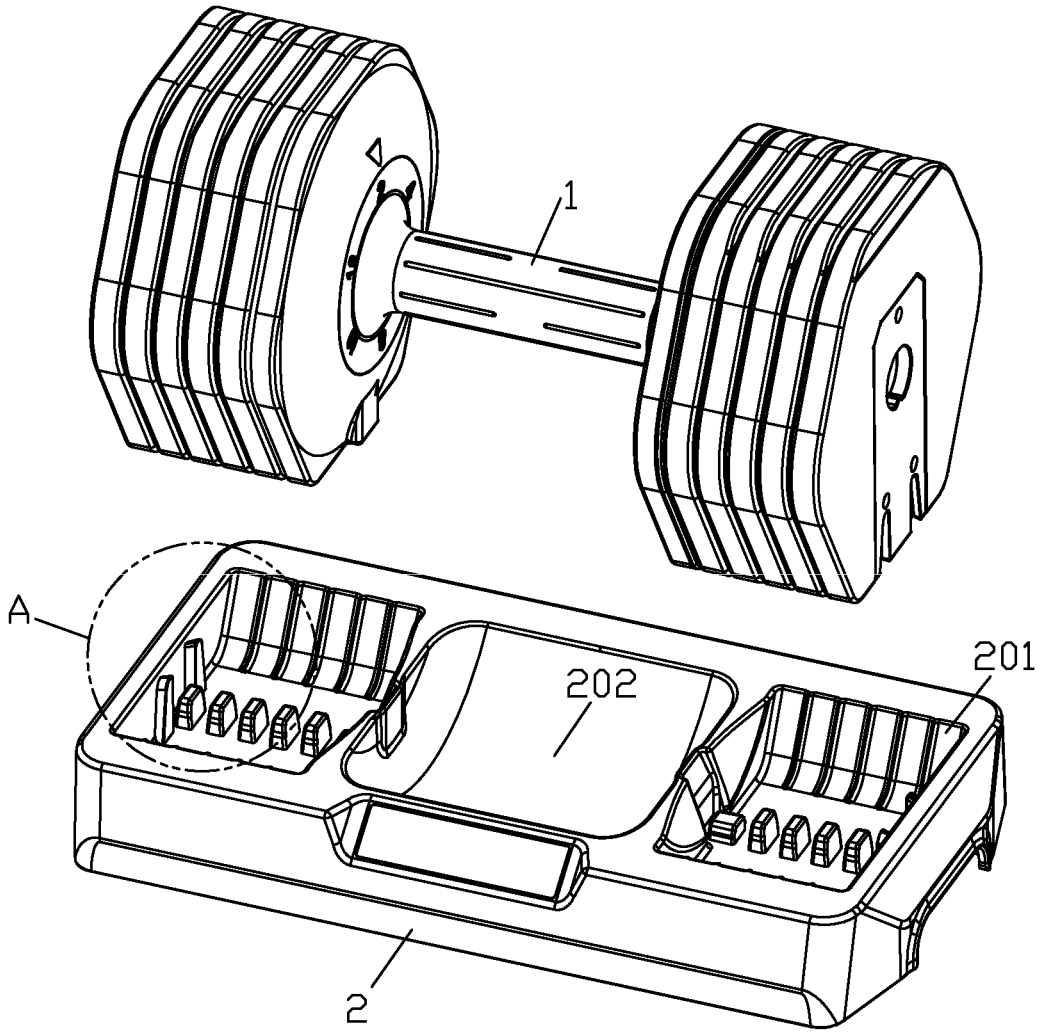
FIG. 2 is an exploded diagram of the adjustable dumbbell in the present disclosure.
Figure 3:
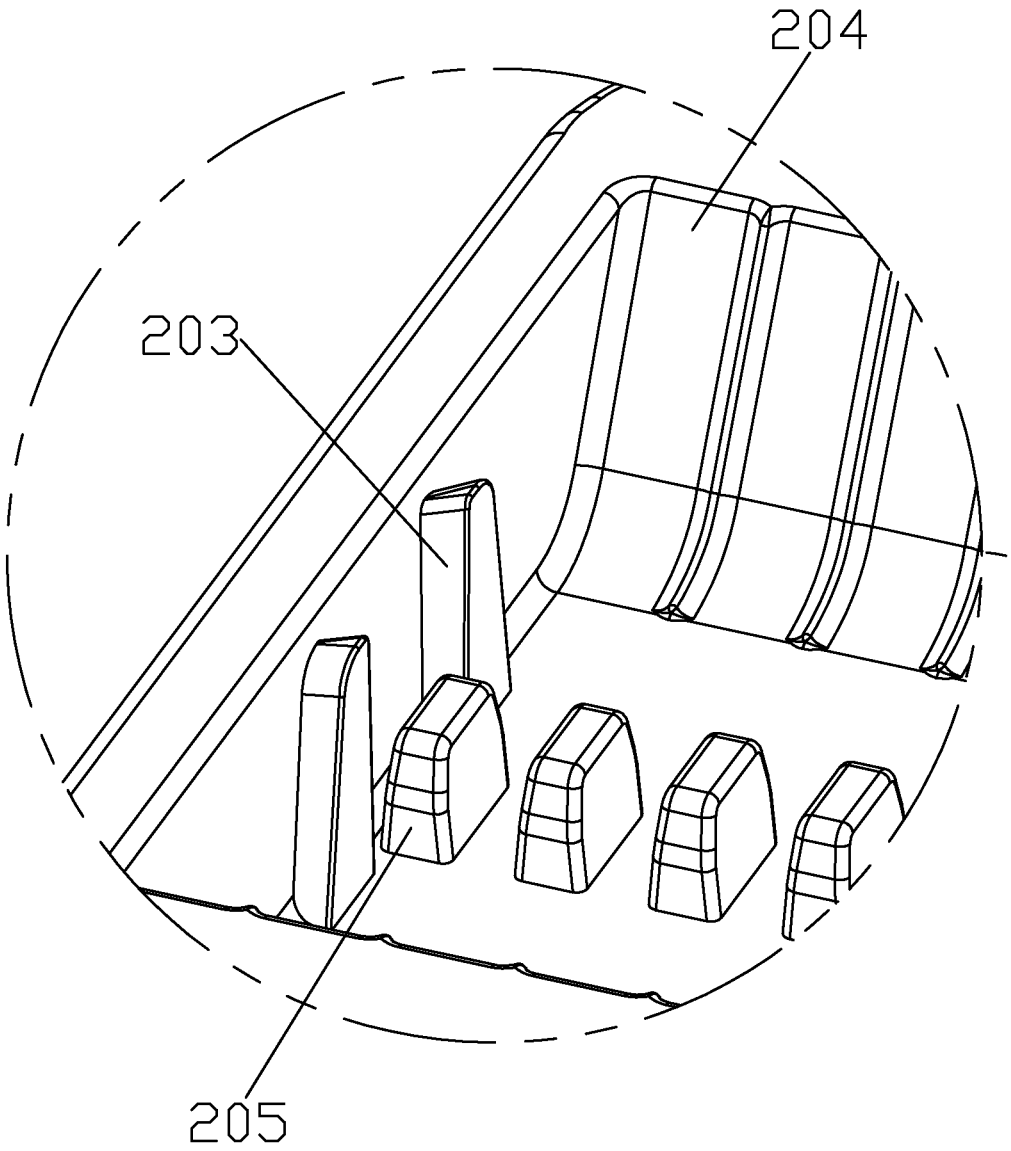
FIG. 3 is an enlarged diagram of position A in FIG. 2.
Figure 4:
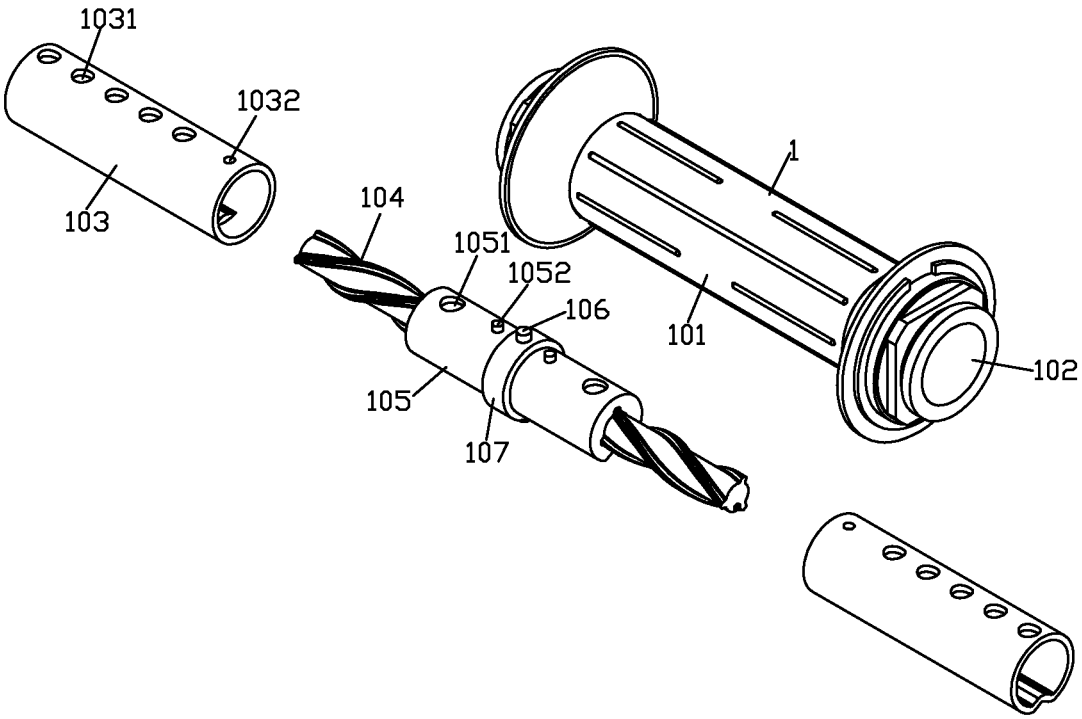
FIG. 4 is an exploded diagram of a grip in the adjustable dumbbell of the present disclosure.
Figure 5:
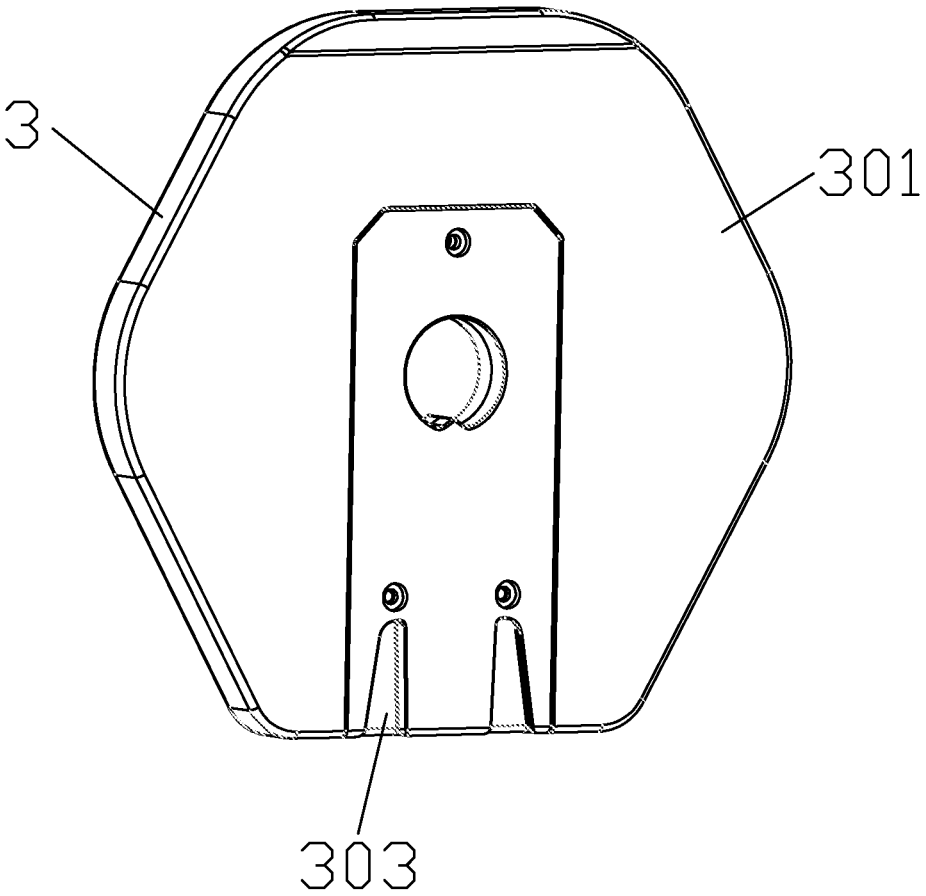
FIG. 5 is a perspective diagram of a dumbbell plate in the adjustable dumbbell in the present disclosure.
Figure 6:
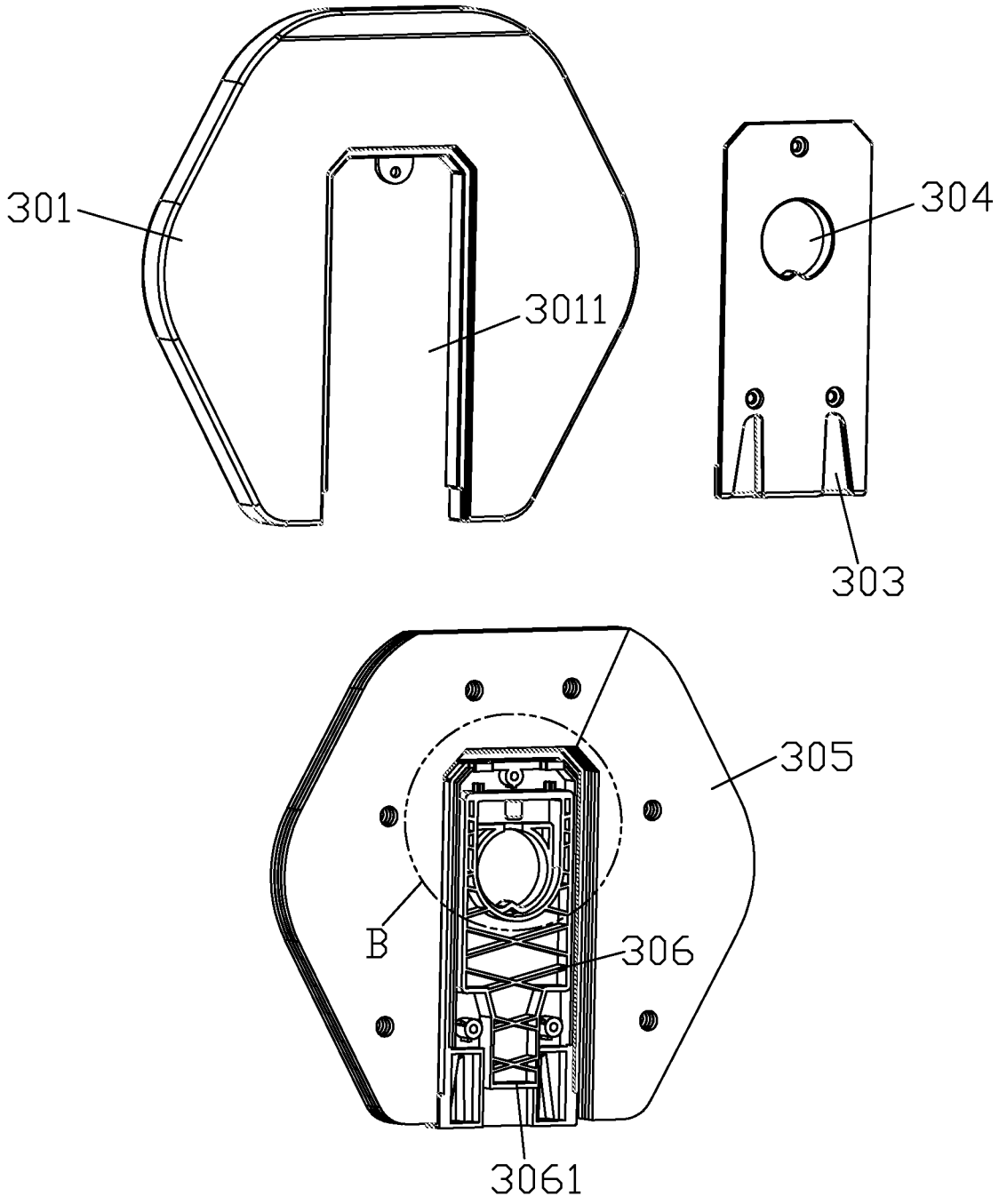
FIG. 6 is an exploded diagram of FIG. 5.
Figure 7:
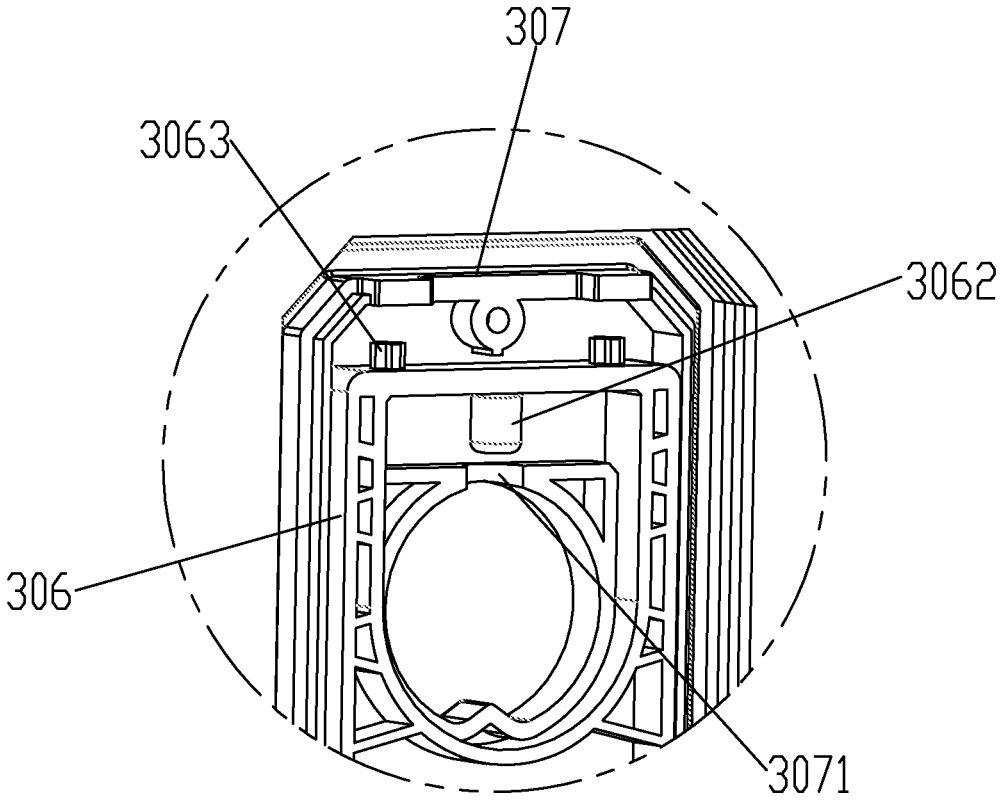
FIG. 7 is an enlarged diagram of position B in FIG. 6.

A dumbbell that is easy to adjust, as shown in FIGS. 1-7, including:

- a dumbbell plate fix seat 2, which is provided with a dumbbell plate fix groove 201 thereon, a bottom of the dumbbell plate fix groove 101 is provided with several locking pieces 205;
- a grip 1, which is provided with a through hole 102 thereon, an interior of the through hole 102 is provided with a connection mechanism, the connection mechanism includes a lead screw 104 and a moving rod 105 slidably connected to the lead screw 104, the moving rod 105 is provided with a second positioning hole 1051, the moving rod 105 is fixedly connected to a connection rod 103, and the connection rod 103 is provided with several first positioning holes 1031 thereon, the grip 1 is connected to the several dumbbell plates 3; the lead screw 104 is driven to rotate by rotating the grip 1, and then the moving rod 105 and connection rod 103 on the lead screw 104 are moved, the connection rod 103 extends into the dumbbell plate connection hole 302 on the dumbbell plate 3;
- each dumbbell plate 3 includes a shell 301 and a weight stack 305 arranged in the shell 301, the shell 301 is fixedly connected to a positioning mechanism, the positioning mechanism is provided with a dumbbell plate connection hole 302; the positioning mechanism includes a base 307 and a cover plate 304, and a moving piece 306 provided between the base 307 and the cover plate 304; the base 307 is provided with a third pin hole 3071, and the moving piece 306 is provided with a third pin 3062 above the third pin hole 3071; an elastic member is provided between an upper of the moving piece 306 and the base 307, the elastic member is used to ensure that the moving piece 306 is not subjected to an external force, and the third pin 3062 is located in the third pin hole 3071, a conflict block 3061 is provided below the moving piece 306, the conflict block 3061 is connected to an outside through the lower of the base 307. In addition, there is a positioning mechanism installation groove 3011 on the shell 301, and the positioning mechanism is fixedly connected to the positioning mechanism installation groove 3011.

When the dumbbell is placed on the dumbbell plate fix seat 2, the conflict block 3061 abuts against the locking piece 205 on the dumbbell plate fix seat 2, and thus, the moving piece 306 is moved upwards. The third pin 3062 separates from the third pin hole 3071, the first positioning hole and second positioning hole, which allows the connection rod 103 to move. By rotating the grip 1, a length of the connection rod 103 extending into the dumbbell plate connection hole 302 is controlled to control the number of dumbbell plates.

When lifting the dumbbell, the conflict block 3061 detaches from the locking piece 205. Due to the elastic member between the moving piece 306 and the base 307, the moving piece 306 is pressed down and reset. The third pin 3062 extends into the third pin hole 3071, the first positioning hole and second positioning hole, and thus, the dumbbell plate 3 is fixed on the connection rod 103.

Specifically, a side wall of the dumbbell plate fix groove 201 is provided with a dumbbell fix block 203, the dumbbell plate 3 is provided with a clamp slot 303, the dumbbell plate 3 is fixed to the dumbbell fix block 203 through the clamp slot 303 to prevent the dumbbell plate from shaking.

Specifically, a bottom of the dumbbell plate fix groove 201 is provided with several dumbbell plate positioning grooves 204 with a width consistent with that of the dumbbell plate 3.

Specifically, the dumbbell plate fix seat 2 is provided with a groove 202 below the grip 1, thereby providing a space for a user to grip the grip conveniently.

As another preferred implementation mode of this embodiment, the lead screw 104 is fixedly connected to a connection sleeve 107, the connection sleeve 107 is provided with a second pin 106, the lead screw 104 is fixedly connected to the grip 1 through the second pin 106, thereby ensuring a stable connection and convenient assembly of spare parts.

Specifically, the grip 1 is provided with an anti-slip sleeve 101 and an anti-slip pattern. When holding the grip 1, it is necessary to avoid sliding between the palm and the grip 1.

Specifically, the connection rod 103 is provided with a first pin hole 1032, the moving rod 105 is provided with a first pin 1052, and the connection rod 103 is fixedly connected to the moving rod 105 through the first pin 1052.

In addition, the moving piece 306 is provided with an elastic member connection block 3063, which is positioned through the elastic member connection block 3063 and abuts against the base 307 to avoid displacement of the elastic member.

From the above description, it can be seen that the embodiments of the present disclosure achieve the following technical effects:

- the present disclosure provides a dumbbell that is easy to adjust, which includes a base, a grip, and dumbbell plates on the grip. The base is provided with a dumbbell plate fix groove, and the bottom of the dumbbell plate fix groove is provided with several locking pieces; there is a through hole on the grip, and the interior of the through hole is provided with a connection mechanism. Each dumbbell plate includes a shell and a weight stack arranged in the shell. The shell is fixedly connected with a positioning mechanism, and the connection rod in the connection mechanism is moved towards both ends of the grip by rotating the grip. The movement length of the connection rod is controlled to control the number of pieces of dumbbell plates connected to the grip, thereby controlling the weight of the dumbbell plate. The dumbbell plates with the above structure are easy to disassemble and assemble, in addition, the positioning mechanism prevents the dumbbell plates from falling off during use and has high safety.

It should be noted that terms used here are only for describing specific embodiments and are not intended to limit exemplary embodiments according to the present application. As used here, unless otherwise explicitly stated in the context, the singular form is also intended to include the plural form. In addition, it should be understood that when terms "including" and/or "comprising" are used in this specification, they indicate the existence of features, steps, operations, devices, components, and/or their combinations.

Unless otherwise specified, the relative arrangement, numerical expressions, and numerical values of the components and steps described in these embodiments do not limit the scope of the present application. At the same time, it should be understood that for ease of description, the dimensions of each part shown in the drawings are not drawn according to the actual proportional relationship. The technology, methods, and equipment known to ordinary technical personnel in the relevant field may not be discussed in detail, but in appropriate cases, such technology, methods, and equipment should be considered as part of the authorization manual. In all embodiments shown and discussed here, any specific value should be interpreted as merely illustrative and not as a limitation. Therefore, other examples of exemplary embodiments may have different values. It should be noted that similar labels and letters represent similar terms in the following drawings, so once a term is defined in one drawing it does not need to be further discussed in subsequent drawings.

In the description of the present application, it should be understood that the orientation or position relationships indicated by directional words such as "front", "back", "up", "down", "left", "right", "horizontal", "longitudinal", "upright", "vertical", "plane", and "top", "bottom" are usually based on the orientation or position relationships shown in the drawings, only for the convenience of describing the present application and simplifying the description. Unless otherwise specified, these directional words do not indicate or imply that the device or component referred to must have a specific orientation or be constructed and operated in a specific orientation, and therefore cannot be understood as a limitation on the protection scope of the present application; in addition, directional words "inner" and "outer" refer to the inner and outer contours relative to each component itself.

It should be understood that when a component is referred to as "on" or "connected to" another component, it can be directly connected to or on that other component, or indirectly connected with an inserted component between the two. On the contrary, when a component is referred to as "directly" on another component or "directly connected" to another component, there is no inserted component between the two.

Furthermore, it should be noted that in the description of the present disclosure, the use of words such as "first" and "second" to define the components is only for the purpose of distinguishing the corresponding components. If not otherwise stated, the above words do not have special meanings and cannot be understood as limiting the protection scope of the present application. In the description of the present disclosure, unless otherwise specified, the meaning of"multiple" refers to two or more.

The above is the preferred embodiments of the present disclosure. It should be pointed out that for ordinary technical personnel in this field, several improvements and embellishments can be made without departing from the principles of the present disclosure. These improvements and embellishments are also considered as the protection scope of the present disclosure.

What is claimed is:

1. An adjustable dumbbell, comprising:

a dumbbell plate fix seat, which is provided with a dumbbell plate fix groove on the dumbbell plate fix seat, a bottom of the dumbbell plate fix groove is provided with several locking pieces;

a grip, which is provided with a through hole, an interior of the through hole is provided with a connection mechanism, the connection mechanism comprises a lead screw and a moving rod slidably connected to the lead screw, the moving rod is provided with a second positioning hole, the moving rod is fixedly connected to a connection rod, the connection rod is provided with several first position holes, the grip is connected to the several dumbbell plates;

wherein each dumbbell plate comprises a shell and a weight stack arranged in the shell, the shell is provided with a positioning mechanism, the positioning mechanism is provided with a dumbbell plate connection hole, the positioning mechanism comprises a base and a cover plate, and a moving piece provided between the base and the cover plate; the base is provided with a third pin hole, and the moving piece is provided with a third pin above the third pin hole, an elastic member is provided between an upper of the moving piece and the base; the elastic member ensures that the moving piece is not subjected to an external force, and the third pin is located in the third pin hole; a conflict block is provided below the moving piece, the conflict block is connected to an outside through a lower of the base.

2. The adjustable dumbbell according to claim 1, wherein a side wall of the dumbbell plate fix groove is provided with a dumbbell fix block, the dumbbell plate is provided with a clamp slot, the dumbbell plate is fixed to the dumbbell fix block through the clamp slot.

3. The adjustable dumbbell according to claim 2, wherein a bottom of the dumbbell plate fix groove is provided with several dumbbell plate positioning grooves with a width consistent with that of the dumbbell plate.

4. The adjustable dumbbell according to claim 3, wherein the dumbbell plate fix seat is provided with a groove below the grip.

5. The adjustable dumbbell according to claim 4, wherein the lead screw is fixedly connected to a connection sleeve, the connection sleeve is provided with a second pin, the lead screw is fixedly connected to the grip through the second pin.

6. The adjustable dumbbell according to claim 2, wherein the lead screw is fixedly connected to a connection sleeve, the connection sleeve is provided with a second pin, the lead screw is fixedly connected to the grip through the second pin.

7. The adjustable dumbbell according to claim 3, wherein the lead screw is fixedly connected to a connection sleeve, the connection sleeve is provided with a second pin, the lead screw is fixedly connected to the grip through the second pin.

8. The adjustable dumbbell according to claim 1, wherein the lead screw is fixedly connected to a connection sleeve, the connection sleeve is provided with a second pin, the lead screw is fixedly connected to the grip through the second pin.

9. The adjustable dumbbell according to claim 8, wherein the grip is provided with an anti-slip sleeve and an anti-slip pattern.

10. The adjustable dumbbell according to claim 9, wherein the connection rod is provided with a first pin hole, the moving rod is provided with a first pin, and the connection rod is fixedly connected to the moving rod through the first pin.

11. The adjustable dumbbell according to claim 10, wherein the moving piece is provided with an elastic member connection block, and the elastic member is positioned through the elastic member connection block and abuts against the base.

* * * * *